United States Patent [19]

Kasahara et al.

[11] Patent Number: 4,837,099

[45] Date of Patent: Jun. 6, 1989

[54] MULTILAYER PHOTOCONDUCTOR FOR ELECTROPHOTOGRAPHY

[75] Inventors: Masahiko Kasahara; Mitsuru Narita, both of Matsumoto, Japan

[73] Assignee: Fuji Electric Co., Ltd., Kawasaki, Japan

[21] Appl. No.: 245,686

[22] Filed: Sep. 16, 1988

[30] Foreign Application Priority Data

Oct. 26, 1987 [JP] Japan ..... 62-269705

[51] Int. Cl.[4] ..... G03G 5/14; G03G 5/082

[52] U.S. Cl. ..... 430/58; 430/57; 430/66

[58] Field of Search ..... 430/57, 58, 66

[56] References Cited

U.S. PATENT DOCUMENTS

| | | | |
|---|---|---|---|
| 2,962,376 | 11/1960 | Schaffert | 430/57 |
| 3,655,377 | 4/1972 | Sechak | 430/57 |
| 4,314,014 | 2/1982 | Yamamoto et al. | 430/57 |
| 4,609,605 | 9/1986 | Lees et al. | 430/58 |

FOREIGN PATENT DOCUMENTS

| | | | |
|---|---|---|---|
| 58-100854 | 6/1983 | Japan | 430/58 |
| 58-182638 | 10/1983 | Japan | 430/57 |
| 59-162558 | 9/1984 | Japan | 430/58 |
| 61-256353 | 11/1986 | Japan | 430/57 |
| 7604387 | 4/1975 | Netherlands | 430/57 |

*Primary Examiner*—Roland E. Martin

*Attorney, Agent, or Firm*—Brumbaugh, Graves, Donohue & Raymond

[57] ABSTRACT

A photoconductor for electrophotography has a unique electron injection-limiting layer of either pure selenium or a selenium-arsenic alloy containing less than 10 weight % arsenic formed between the carrier generation layer and the surface protective layer, which suppresses the transfer of electrons to the surface protective layer and prevents a drop in the electrostatic surface potential.

4 Claims, 1 Drawing Sheet

MULTILAYER PHOTOCONDUCTOR FOR ELECTROPHOTOGRAPHY

BACKGROUND OF THE INVENTION

The present invention relates to a photoconductor for use in an electrophotographical copier or printer which uses as its light source a gas laser, laser diode, light-emitting diode, liquid crystal, CRT, or the like, and which, more particularly, comprises a conductive base on which a carrier transport layer, a carrier generation layer, and a surface protective layer are formed.

The light source of an electrophotographic copier or printer uses a single wavelength of electromagnetic radiation in the range of about 630 to 800 nm, which enables copied information to be transferred, stored and edited. In order for the photoconductor to respond to light of such long wavelength, a function-separating type multilayer photoconductor is used. Such a photoconductor comprises a carrier generation layer of a selenium-tellerium alloy which responds to electromagnetic radiation of such long wavelengths; a carrier transport layer of selenium-arsenic (Se-As) alloy which conveys the carriers produced in the carrier generation layer; and a surface protective layer of Se-As alloy which provides excellent resistance to chemicals, printing, and heat, and thus protects the carrier generation layer form external stress.

In an electrophotographic printer or copier equipped with such a photoconductor, the photoconductor is first electrically charged to provide a uniform electrostatic charge to its surface. The charged surface is then exposed to light to form an electrostatic latent image. A developing device supplies toner to the latent image to create a toner image, which is then transferred to paper by heat or pressure.

The use of the Se-As alloy in the surface protective layer protects the carrier generation layer from external stress caused by printing and heating operations. While this resistance is improved by a proportionate increase in the amount of arsenic in the surface protective layer, such an increase will, at the same time, have negative effects, such as reducing the rate at which the surface charge is retained, and causing deterioration of the ability of the surface layer to resist fatigue.

A further problem in the prior art devices exists with respect to surface potential. Generally, photoconductors used in printers and copiers are positively charged (except for OPC photoconductors). However, though the photoconductor undergoes repeated positive charging, the surface potential drops unfavorably. After carriers are generated inside the carrier generation layer, positive holes move away from the surface and toward the substrate. Simultaneously, electrons are transported toward the surface. If these elections become trapped in the surface protective layer, negative space charges are produced, thus lowering the surface potential.

Further adding to a decrease in surface potential is the ease by which electrons can move to the surface. Where, as here, the band gap of the surface protective layer is relatively narrow (about 2.0 eV for amorphous selenium), there is little resistance to electron movement.

SUMMARY OF THE INVENTION

It is thus an object of the present invention to provide an electrophotographic photoconductor having a surface protective layer of selenium-arsenic alloy which contains a high percentage of arsenic.

It is a further object to provide such a photoconductor which exhibits excellent resistance to stress caused by both printing and heat, has improved retention of surface charge, displays improved fatigue characteristics, and continues to produce a sharp printed image even after repeated printing of characters.

The above objects are achieved by the novel presence of an electron injection-limiting layer formed between the carrier generation layer and the surface protective layer, which suppresses the transfer of electrons to the surface protective layer and prevents a drop in the electrostatic surface potential. The electron injection-limiting layer is of either pure selenium or a selenium-arsenic alloy containing less than 10% arsenic by weight.

DESCRIPTION OF THE PREFERRED EMBODIMENTS

Figure 1:
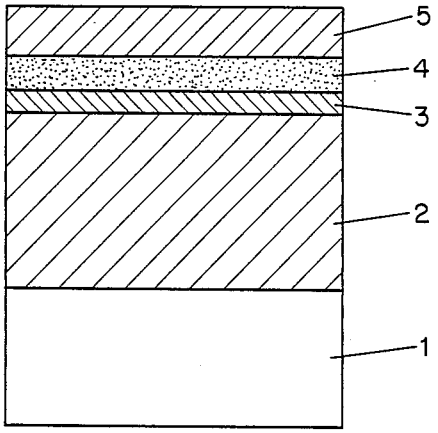
FIG. 1 is a cross-sectional view of the photoconductor of Example 1.

Referring to FIG. 1, a photoconductor of the claimed invention comprises a conductive base 1 upon which are formed in sequence a carrier transport layer 2 of a selenium-arsenic alloy; a carrier generation layer 3 of selenium-tellurium alloy; an electron injection-limiting layer of either pure selenium or selenium-arsenic alloy containing less than 10 weight % arsenic, the thickness of the electron injection-limiting layer being preferably less than 10 μm; and a surface protective layer 5 of selenium-arsenic alloy.

The conductive base 1, carrier transport layer 2 and carrier generation layer 3 exist in a fashion similar to that of known photoconductors. Additional, however, is the presence of an electron injector-limiting layer 4 between the carrier generation layer 3 and the surface protective layer 5. The limiting layer 4 is of either pure selenium or a selenium-arsenic alloy with less than 10 weight % arsenic. This unique composition gives a band gap wider than that of either adjacent layer and thus inhibits the movement of electrons generated within the carrier generation layer 3 to the surface protective layer 5. This prevents an unwanted drop in the electrostatic surface potential, which must remain high for effective transfer of the latent image to the paper.

The addition of arsenic to the selenium of the limiting layer 4 improves the layer's resistance to deterioration by crystallization. The addition of arsenic will, however, have the undesired effect of reducing the band gap, thereby reducing the suppression of electron transfer. Thus, the amount of arsenic added to the limiting layer 4, between 0 and 10 weight percent, may be varied so as to obtain an appopriate balance between the two competing effects.

The thickness of the electron injection-limiting layer should preferably not exceed 10 μm, at which point the sensitivity of the layer to the light of long wavelengths employed begins to drop.

The production of the preferred embodiments is set forth in detail in Examples 1 and 2, while Examples 3 and 4 describe prior art devices which were tested for the purposes of comparison.

EXAMPLE 1

Referring to FIG. 1, there is shown a photoconductor according to the invention. This photoconductor includes a conductive base 1 on which a carrier transport layer 2 and a carrier generation layer 3 are stacked, similarly to the prior art photoconductor. This photoconductor is characterized by an electron injecting-limiting layer 4 and a surface protective layer 5 formed on the carrier generation layer 3. This photoconductor was fabricated in the manner described below.

A machined and cleaned aluminum cylinder having a diameter of 80 mm was mounted on a support shaft of an evaporating apparatus. The temperature of the aluminum base 1 was maintained at about 190° C. Then, the inside was evacuated to $1\times10^{-5}$ torr. Subsequently, an evaporating source including an $As_2Se_3$ alloy was heated at about 400° C. The carrier transport layer 2 having a thickness of about 60 μm was formed by deposition. The carrier generation layer 3 and the electron injection-limiting layer 4 were then formed by flash evaporation. The thickness of the layers 3 and 4 were about 0.5 μm and 2 μm, respectively. The carrier generation layer 3 consisted of Te and Se, and Te accounted for 44% by weight. The limiting layer 4 consisted of As and Se, the arsenic accounting for 5% by weight. The flash evaporation operations were effected under the following conditions: the temperature of the support shaft was 60° C.; the pressure was $1\times10^{-5}$ torr; the temperature of the evaporating source was about 350° C. The surface protective layer 5 having a thickness of about 3 μm and consisting of As and Se was formed on the limiting layer 4. The arsenic in the surface protective layer 5 accounted for 30% by weight.

EXAMPLE 2

Figure 2:
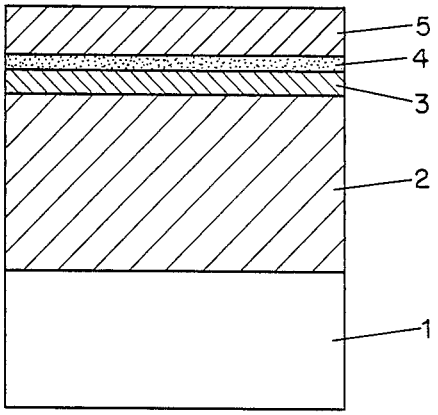
FIG. 2 is a cross-sectional view of the photoconductor of Example 2.

Referring to FIG. 2, the injection-limiting layer 4 is thinner than the limiting layer 4 of Example 1. The layer 4 consisted of As and Se, and contained 5% arsenic by weight. This layer 4 was deposited to a thickness of about 0.5 μm by flash evaporation. The aluminum base 1, including the machining and cleaning thereof, and the deposition of the carrier transport layer 2, the carrier generation layer 3, and the surface protective layer 5 were similar to the counterparts of Example 1.

EXAMPLE 3

Figure 3:
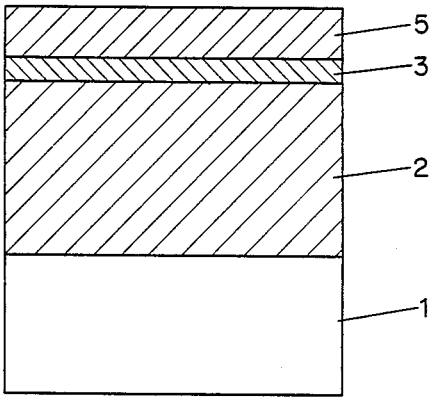
FIG. 3 is a cross-sectional view of the photoconductor of Example 3.

FIG. 3 shows a photoconductor of Example 3, having no electron injection-limiting layer, and consisting of a conductive base 1, a carrier transport layer 2, a carrier generation layer 3, and a surface protective layer 5. These layers were deposited to the same thicknesses and by the same methods as those in Example 1.

EXAMPLE 4

Figure 4:
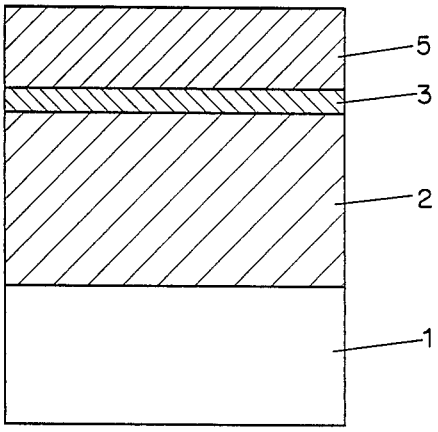
FIG. 4 is a cross-sectional view of the photoconductor of Example 4.

FIG. 4 shows a photoconductor of Example 4 having no electron injection-limiting layer. A carrier transport layer 2, a carrier generation layer 3, and a surface protective layer 5 were formed on a base 1. The carrier transport layer 2 consisted of pure selenium and was deposited to a thickness of about 60 μm. The carrier-generation layer 3 consisted of Te and Se, and Te accounted for 44% by weight. The layer 3 was deposited to a thickness of about 0.5 μm by flash evaporation. The surface protective layer 5 consisted of Te and Se, and Te accounted for 10% by weight. The layer 5 was deposited to a thickness of about 5 μm by flash evaporation.

The examples of photoconductors fabricated in this way were each used 300 times. Then, the fatigue characteristics and the surface hardness of each photoconductor were measured at room temperature. The results are shown in Table 1.

TABLE 1

| | Fatigue Characteristics | | | | |
|---|---|---|---|---|---|
| Photo-con-ductor | Amt. of Dark Decay | Amt. of surface Potential Drop | Residual Potential | surface hard-ness | overall evalu-ation |
| Example 1 | 50 V | 70 V | 50 V | 150 | superior |
| Example 2 | 70 | 90 | 45 | 150 | superior |
| Example 3 | 150 | 160 | 45 | 150 | inferior |
| Example 4 | 50 | 60 | 50 | 50 | inferior |

The amount of dark decay noted under fatigue characteristics represents the degree of retention of surface charge. As the value of the amount of dark decay decreases, a better result is obtained, i.e. superior transfer of the latent image from the surface to the paper. Also, as the amount of surface potential drop and the residual potential decrease, a larger allowance is given to the electrophotographic apparatus. As the surface hardness increases, the resistance to printing stress improves. The table shows that the photoconductors of Examples 1, 2 and 3, each having a surface protective layer of an Se-As alloy containing a relatively large percentage of As were far superior in resistance to printing stress than the photoconductor of Example 4, which contained Te rather than As. Example 3, however, which lacks the electron injection-limiting layer of the invention has a high level of dark decay and a high level of dark decay and a high surface potential drop. Thus, the photoconductors of Examples 1 and 2, in accordance with the invention, provide superior characteristics.

We claim:

1. A photoconductor for electrophotography comprising, in sequence:

(a) a conductive base;

(b) a carrier transport layer comprising a selenium-arsenic alloy;

(c) a carrier generation layer comprising a selenium-tellurium alloy;

(d) an electron injection-limiting layer comprising selenium and up to 10 weight percent of arsenic; and (e) a surface protective layer comprising a selenium-arsenic alloy different in composition from said electron injection-limiting layer.

2. The photoconductor of claim 1, wherein the thickness of the electron injection-limiting layer is less than 10 μm.

3. The photoconductor of claim 2, wherein the surface protective layer contains approximately 30 weight percent arsenic.

4. The photoconductor of claim 2, wherein the electron injection-limiting layer contains approximately 5 weight percent arsenic.

* * * * *